US006167822B1

(12) United States Patent
Miyasako et al.

(10) Patent No.: US 6,167,822 B1
(45) **Date of Patent: *Jan. 2, 2001**

(54) PATTERN SEWING MACHINE

(75) Inventors: Masami Miyasako; Hiroshi Horimoto, both of Hiroshima (JP)

(73) Assignee: Juki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/966,070

(22) Filed: Nov. 10, 1997

(30) Foreign Application Priority Data

Nov. 11, 1996 (JP) ..... 8-314187

(51) Int. Cl.[7] ..... D05B 21/00; D05C 5/02

(52) U.S. Cl. ..... 112/102.5; 112/445

(58) Field of Search ..... 112/102.5, 470.04, 112/470.06, 475.19, 456, 458, 445; 364/470.09; 700/138

(56) References Cited

U.S. PATENT DOCUMENTS 4,520,745 * 6/1985 Shinomiya et al. ..... 112/103 X
4,660,488 * 4/1987 Hanyu et al. ..... 112/456 X
4,742,786 * 5/1988 Hashimoto et al. ..... 112/103 X
4,915,041 * 4/1990 Takenoya ..... 112/103 X
5,553,559 * 9/1996 Inoue et al. .
5,791,270 * 8/1998 Mori ..... 112/102.5

* cited by examiner

*Primary Examiner*—Peter Nerbun
(74) *Attorney, Agent, or Firm*—Morgan & Finnegan LLP

(57) ABSTRACT

A pattern sewing machine which recognizes a reference point of a cloth in a cloth holding frame 2 by recognition means 11, can space stitch point data of the current sewing pattern to be sewn in the cloth holding frame 2 at a predetermined pattern distance apart from the already formed embroidered pattern in X and Y directions by correction means **13*i* based on the reference point, detects a rotation direction shift of the cloth set in the cloth holding frame 2 by rotation direction shift detection means 13*g*, and corrects the stitch point data spaced at the predetermined pattern distance apart from the already formed embroidered pattern in the X and Y directions in the rotation direction with the reference point as the center by the correction means 13*i*** based on the reference point and the cloth rotation direction shift, thereby finely matching the relative positions of the already formed sewing pattern and the subsequent sewing pattern to be sewn.

8 Claims, 10 Drawing Sheets

FIG. 6
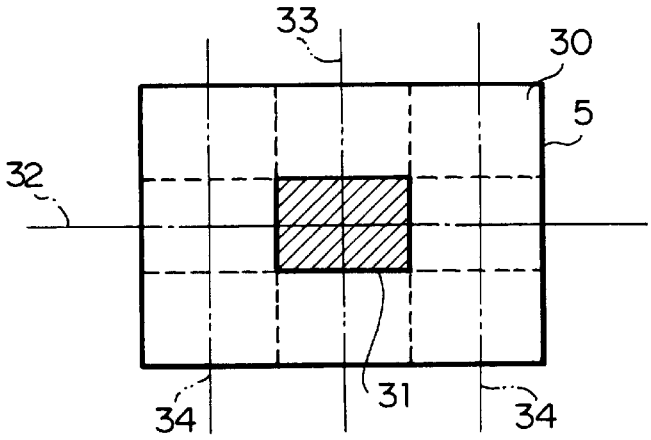
FIG. 7(a)
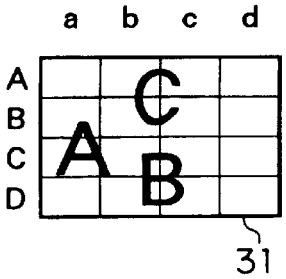
ENLARGEMENT COMMAND
FIG. 7(b)
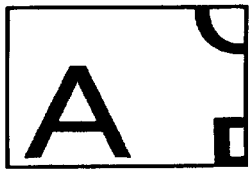
FIG. 7(c)
| HORIZONTAL / VERTICAL | a AND b | b AND c | c AND d |
|---|---|---|---|
| A and B | i | ii | iii |
| B and C | iv | v | vi |
| C and D | vii | viii | ix |

PATTERN SEWING MACHINE

BACKGROUND OF THE INVENTION

This invention relates to a pattern sewing machine, a pattern sewing method, and a pattern display method.

Hitherto, a sewing pattern, such as an embroidered pattern, has been prepared assuming that it is formed by one sewing within the sewable range of an embroidery frame (cloth holding frame). However, a large-sized pattern or an embroidered pattern of a long character string, etc., may be sewn, in which case the large-sized pattern or the embroidered pattern of a long character string, etc., cannot all be formed by one sewing since the pattern to be sewn is too large to be accepted within the frame. Thus, upon completion of formation of a predetermined part of the pattern by the first sewing, the cloth is removed from the embroidery frame and is slid so that the pattern part to be formed by the next sewing enters the embroidery frame, then again set on the embroidery frame for the next sewing.

To once remove the cloth from the embroidery frame and slide the cloth, then again set the cloth on the embroidery frame, the relative positions of the already formed embroidered pattern and the subsequent embroidered pattern to be sewn need to be matched. Therefore, when again setting the cloth on the embroidery frame, the worker visually checks that the already formed embroidered pattern is parallel to the embroidery frame and that the first stitch point position of the subsequent embroidered pattern to be sewn is placed at a position spaced at a predetermined pattern distance apart from the already formed embroidered pattern in X and Y directions. Of course, because of visual checking, the precision is poor and a desired fine embroidered pattern cannot be provided.

SUMMARY OF THE INVENTION

It is therefore an object of the invention to provide a pattern sewing machine, a pattern sewing method, and a pattern display method capable of finely matching the relative positions of an already formed sewing pattern and a subsequent sewing pattern to be sewn and improving the sewing quality.

To accomplish the object, according to a first aspect of the invention, there is provided a pattern sewing machine comprising: a cloth holding frame having a predetermined area, for holding a cloth; a driving member for moving said cloth holding frame in X and Y directions; display means having a display screen, for displaying a pattern to be sewn, wherein the pattern displayed on said display screen is stitched on the cloth held by said cloth holding frame which is moved in the X and Y directions; rotation direction shift detection means for detecting a rotation direction shift of the cloth set in said cloth holding frame; recognition means for recognizing a reference point of the cloth in said cloth holding frame; and correction means for instructing a correction to said drive member based on the reference point recognized by said recognition means and the cloth rotation direction shift detected by said rotation direction shift detection means.

According to a second aspect of the invention, there is provided the pattern sewing machine of the first aspect, further comprising: means for setting a reference line on the cloth to form embroidery sewing; means for forming a part of an embroidery based on embroidery data on the cloth held in said cloth holding frame such that the reference line is placed along one side of said cloth holding frame; means for changing the holding position of the cloth in the cloth holding frame so as to enable a different part of the embroidery to be successively formed in a different place of the cloth; means for setting two points on the reference line of the cloth held in said cloth holding frame; means for correcting sewn embroidery data by transforming the sewn embroidery data so that the data corresponds to a rotated pattern with a predetermined reference point as a center of a line extending between the two setup points; and means for forming the different part of the embroidery based on the corrected embroidery data.

According to a third aspect of the invention, there is provided the pattern sewing machine of the second aspect, wherein the predetermined reference point is read before or after the two points are read, whereby the reference point is set.

According to a fourth aspect of the invention, there is provided the pattern sewing machine of the second or third aspect, wherein the two points or the predetermined reference point is set on said display screen.

According to a fifth aspect of the invention, there is provided a pattern sewing machine for forming an embroidery of a size that cannot be sewn in an embroidery frame without repositioning the workpiece with respect to the frame, said pattern sewing machine comprising: means for displaying a reference line set on a cloth to form embroidery sewing; means for displaying an embroidery to be sewn on the cloth held in the embroidery frame along the displayed reference line based on embroidery data; means for displaying two points on a new reference line of the cloth held in the embroidery frame; and means for correcting sewn embroidery data by transforming the sewn embroidery data so that the data corresponds to a rotated pattern with a predetermined reference point as the center of a line extending between the two points.

According to a sixth aspect of the invention, there is provided the pattern sewing machine of the fifth aspect, wherein the predetermined reference point is displayed before or after the two points are displayed.

According to a seventh aspect of the invention, there is provided a pattern sewing machine comprising: a cloth holding frame having a predetermined area, for holding a cloth; a driving member for moving said cloth holding frame in X and Y directions; display means having a display screen, for displaying a pattern to be sewn, wherein the pattern displayed on said display screen is stitched on the cloth held by said cloth holding frame which is moved in the X and Y directions; means for assigning an absolute position of the cloth hold by said cloth holding frame; means for rearranging the pattern displayed on said display screen such that the pattern corresponds to the absolute position; means for controlling said driving member to form the pattern corresponding to the pattern rearranged on the display screen.

According to an eighth aspect of the invention, there is provided the pattern sewing machine of the seventh aspect, wherein the absolute position is a rotational direction position.

According to a ninth aspect of the invention, there is provided the pattern sewing machine according to claim 7 or 8, wherein the absolute position is a particular reference position on the part of pattern which has been sewn.

The pattern sewing machine of the invention recognizes the reference point of the cloth in the cloth holding frame by the recognition means, can space the stitch point data of the current sewing pattern to be sewn in the cloth holding frame at a predetermined pattern distance apart from the already formed embroidered pattern in the X and Y directions by the correction means based on the reference point, detects a rotation direction shift of the cloth set in the cloth holding frame by the rotation direction shift detection means, and corrects the stitch point data spaced at the predetermined pattern distance apart from the already formed embroidered pattern in the X and Y directions in the rotation direction with the reference point as the center by the correction means based on the reference point and the cloth rotation direction shift. Therefore, the relative positions of the already formed sewing pattern and the subsequent sewing pattern to be sewn can be matched finely.

According to the pattern sewing machine, to form an embroidery of a size that cannot go in the embroidery frame at a time, the relative positions of the already formed sewing pattern and the subsequent sewing pattern to be sewn can be matched finely.

According to the pattern sewing machine, the steps are displayed, so that operability can be improved.

BRIEF DESCRIPTION OF THE DRAWINGS

FIG. 6 is a front view to show an LCD screen as display means;

FIGS. 7(*a*) to 7(*c*) are illustrations to show one embodiment of a layout screen;

DETAILED DESCRIPTION OF THE PREFERRED EMBODIMENTS

Figure 1:
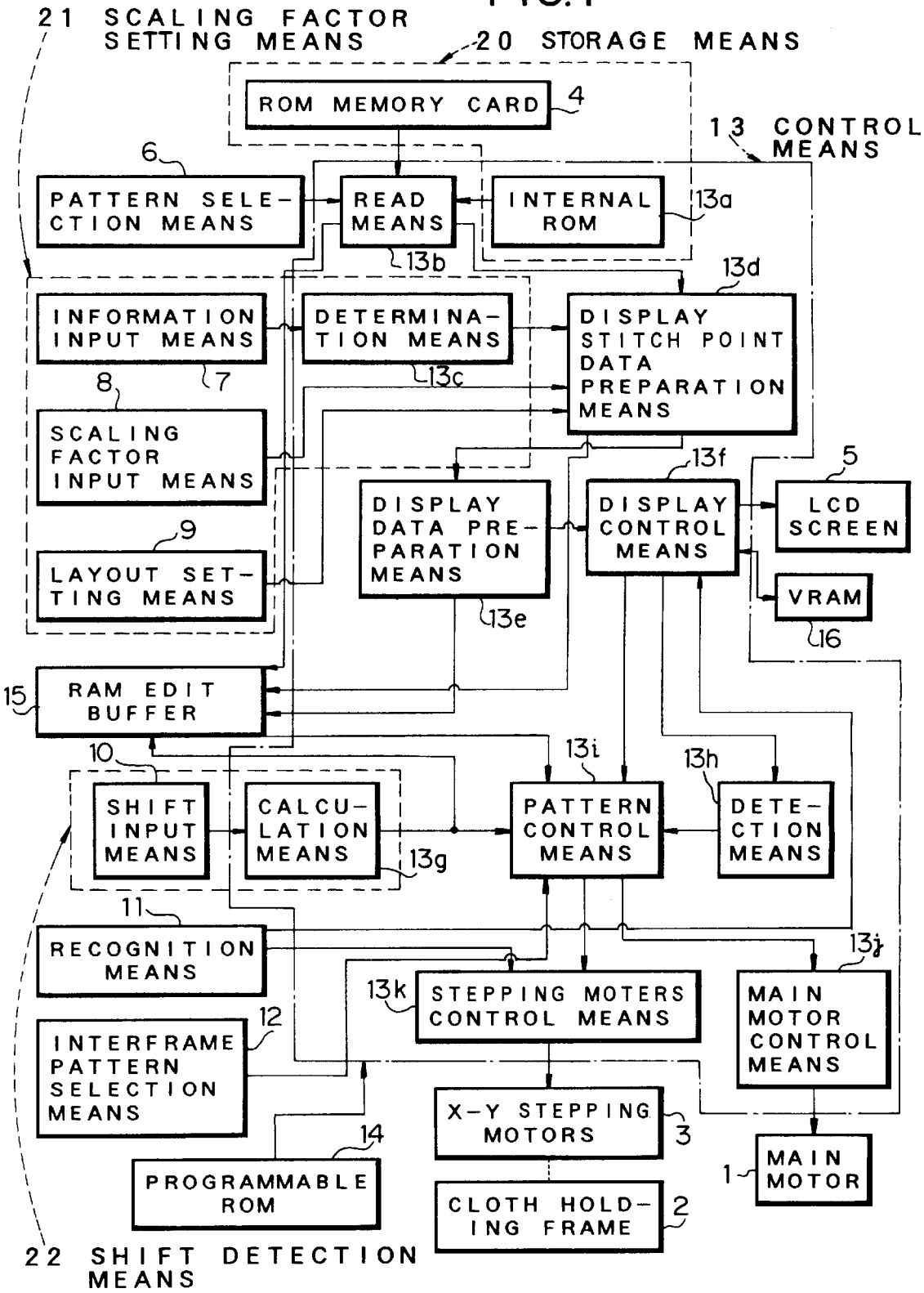
FIG. 1 is a block diagram to show the configuration of a pattern sewing machine in one embodiment of the invention.
Figure 17:
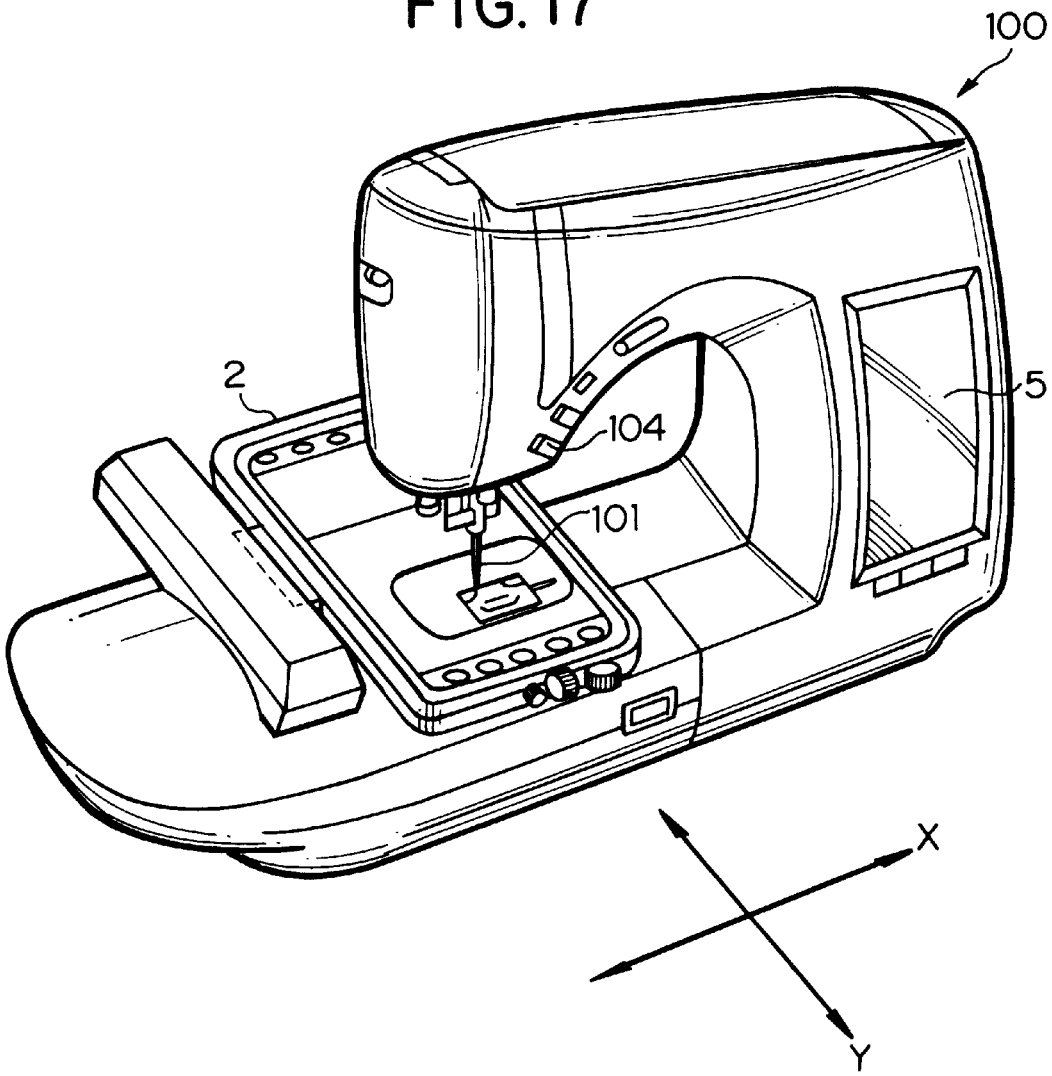
FIG. 17 is a perspective view of a sewing machine.

Referring now to the accompanying drawings, there is shown a preferred embodiment of the invention. FIG. 1 is a block diagram to show the configuration of a pattern sewing machine in one embodiment of the invention. FIG. 17 is a perspective view of a sewing machine. The pattern sewing machine of the embodiment comprises a main motor 1 for moving a needle 101 of a sewing machine 100 up and down, a x-y stepping motors 3 on which a cloth holding frame (embroidery frame) 2 is mounted for moving the cloth holding frame 2 in the X and Y directions, and a ROM (read-only memory) card 4 detachably installed for storing pattern data such as stitch point data of embroidered pattern.

The pattern sewing machine of the embodiment further includes an LCD screen 5 as display means for displaying an embroidered pattern, etc., and an operation panel having an input switch, etc., required for displaying an embroidered pattern, etc., on the LCD screen 5.

The operation panel 5 comprises pattern selection means 6 for selecting an embroidered pattern, information input means 7 for entering information indicating the size of a cloth holding frame which has been selected from among a plurality of cloth holding frames, scaling factor input means 8 for enabling the operator to set any scaling factor for the embroidered pattern displayed on the LCD screen 5, layout setting means 9 for enabling the operator to set a layout of the embroidered pattern displayed on the LCD screen 5 and specifying enlargement of a predetermined partition in the LCD screen 5 in the layout, shift input means 10 for entering two predetermined points of a cloth in the cloth holding frame 2 to detect a shift of the cloth set in the cloth holding frame 2 in the rotation direction, recognition means 11 for specifying a cloth reference point in the cloth holding frame 2 on the LCD screen 5 to recognize the reference point and driving the x-y stepping motors 3 so that the reference point matches a given stitch point position, and intraframe pattern selection means 12 for selecting one embroidered pattern to be sewn if a plurality of embroidered patterns exist in the cloth holding frame displayed on the LCD screen 5.

The pattern sewing machine of the embodiment further includes control means (CPU) 13 for receiving signals from the ROM card 4, the pattern selection means 6, the information input means 7, the scaling factor input means 8, the layout setting means 9, the shift input means 10, the recognition means 11, and the intraframe pattern selection means 12 and sending operation signals to the main motor 1, the x-y stepping motors 3, and the LCD screen 5.

A programmable ROM 14 for storing an operation control program is connected to the control means 13 so that the program can be input to the control means 13. Also, a RAM edit buffer 15 for temporarily storing read stitch point data, enlarged or reduced stitch point data for display, display data, and the calculated cloth rotation direction shift amount and a VRAM 16 for temporarily storing LCD display data are connected to the control means 13 so that data, etc., can be input to and output from the control means 13.

The control means 13 roughly has a first function of enlarging or reducing the embroidered pattern selected through the pattern selection means 6 based on stitch point data and displaying the resultant pattern on the LCD screen 5 and enabling the worker to set a layout of the embroidered pattern while seeing the LCD screen 5 and a second function of correcting stitch point data so as to finely match the relative position of the subsequent embroidered pattern to be sewn with the already sewn embroidered pattern when bridge embroidery (sewing a large-sized embroidered pattern or an embroidered pattern of a character string, etc., over multiple times) is executed.

That is, as the first function, the control means 13 comprises an internal ROM 13*a* for storing pattern data such as stitch point data of embroidered pattern different from the pattern data stored in the ROM card 4, read means 13*b* for reading the stitch point data of the embroidered pattern selected through the pattern selection means 6 from the ROM card 4 or the internal ROM 13*a*, determination means 13*c* for determining the enlargement or reduction factor of an embroidered pattern displayed on a reference screen based on the size of the cloth holding frame 2 entered through the information input means 7 and the size of the cloth holding frame displayed on the LCD screen 5, display stitch point data preparation means 13*d* for enlarging or reducing the stitch point data read by the read means 13*b* based on the scaling factor determined by the determination means 13*c*, the scaling factor entered through the scaling factor input means 8, or the partition (enlargement factor) whose enlargement is specified through the layout setting means 9, display data preparation means 13*e* for converting stitch point data enlarged or reduced by the display stitch point data preparation means 13*d* into display data that can be displayed on the LCD screen 5, and display control means 13*f* for controlling the operation of the LCD screen 5 so that the display data provided by the display data preparation means 13*e* can be displayed on the LCD screen 5.

As the second function, the control means 13 comprises calculation means 13*g* for calculating the shift amount of a set cloth in the rotation direction based on two predetermined points of the cloth within the cloth holding frame 2 entered through the shift input means 10 and detection means 13*h* for detecting an embroidered pattern within the cloth holding frame displayed on the LCD screen 5 under the control of the display control means 13*f*.

As the second function, the control means 13 further includes pattern control means (containing correction means) 13*i* for reading the stitch point data of the subsequent embroidered pattern to be sewn, displayed on the LCD screen (the stitch point data of the already sewn embroidered pattern may be read together with that stitch point data) from the RAM edit buffer 15 based on the embroidered pattern within the cloth holding frame on the screen detected by the detection means 13*h* if one embroidered pattern is displayed within the cloth holding frame on the LCD screen or based on the embroidered pattern within the cloth holding frame on the screen selected through the intraframe pattern selection means 12 if two or more embroidered patterns are displayed within the cloth holding frame on the LCD screen.

When the display control means 13*f* is controlled and a reference point on the LCD screen 5 (in the embodiment, one point in an already formed embroidered pattern) is specified by the recognition means 11 (at this time, the recognition means 11 sends a command to stepping motor control means 13*k* (described later) for manually controlling the x-y stepping motors 3 so that a given stitch point position matches the reference point), the pattern control means 13*i* recognizes the reference point on the LCD screen 5, grasps the move coordinates from the reference point to the first stitch point position of the subsequent embroidered pattern to be sewn based on the display data, the enlarged or reduced stitch point data for display, and the read stitch point data temporarily stored in the RAM edit buffer 15 (based on the correlation among the data pieces), and makes a rotation correction of the read stitch point data about the reference point based on the cloth rotation direction shift amount found by the calculation means 13*g*.

The pattern control means 13*i* sends a drive command to the stepping motor control means 13*k* for controlling drive of the x-y stepping motors 3 based on the read stitch point data or the corrected stitch point data and a drive command to the main motor control means 13*j* for controlling drive of the main motor 1. On the other hand, upon completion of sewing the embroidered pattern in the cloth holding frame on the screen detected by the detection means 13*h* or the embroidered pattern in the cloth holding frame on the screen selected through the intraframe pattern selection means 12, the pattern control means 13*i* sends a stop command to the stepping motor control means 13*k* and a stop command to the main motor control means 13*j*.

Here, the ROM card 4 and the internal ROM 13*a* make up storage means 20; the information input means 7, the determination means 13*c*, the scaling factor input means 8, and the layout setting means 9 make up scaling factor setting means 21; and the shift input means 10 and the calculation means 13*g* make up cloth rotation direction shift detection means 22.

The operation functions of the means will be discussed later in more detail.

Figure 5:
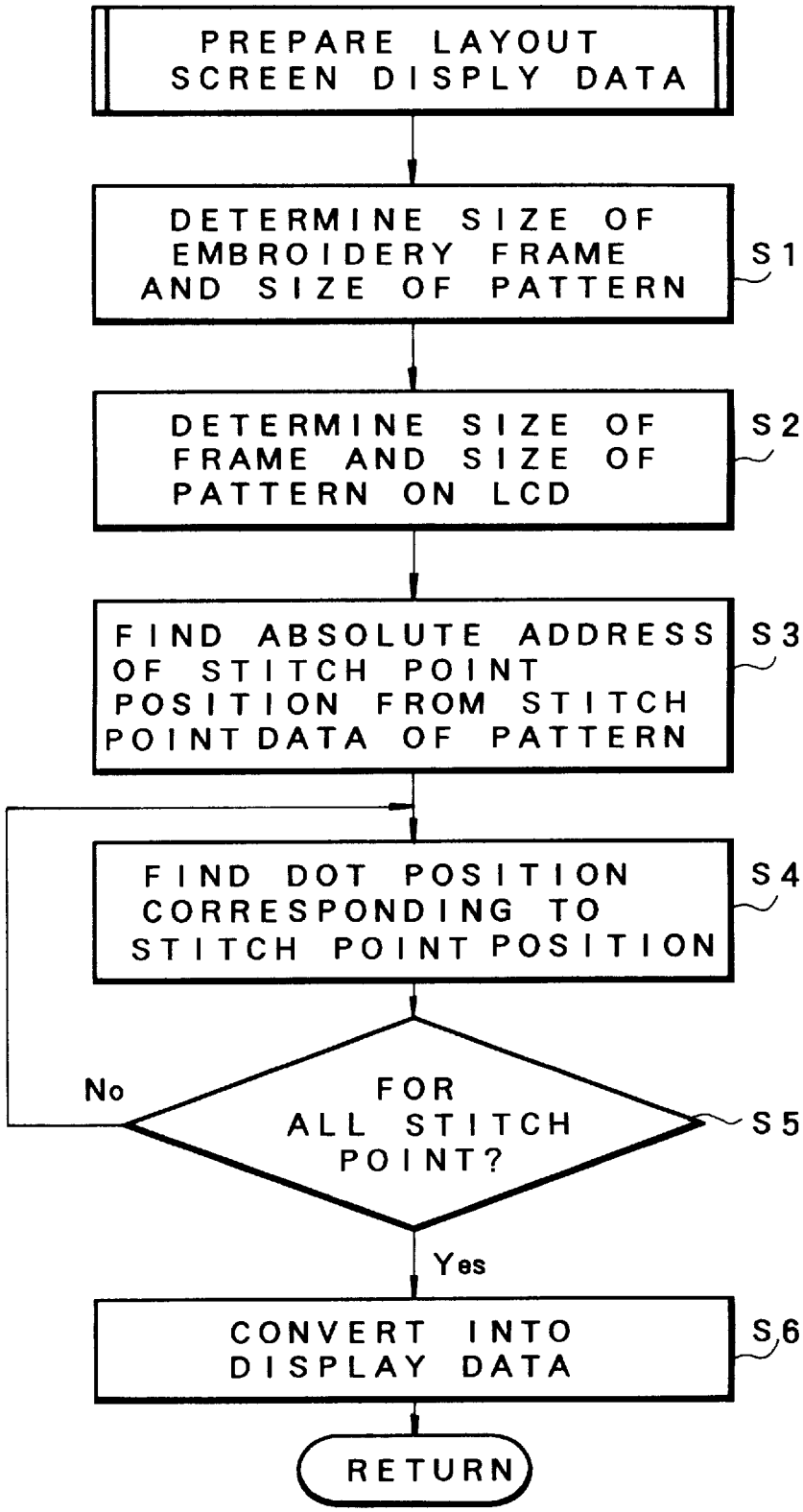
FIG. 5 is a flowchart to show an operation sequence of preparing layout screen display data in FIG. 2 in detail.

Next, the operation of the pattern sewing machine thus configured will be discussed with reference to flowcharts shown in FIGS. 2 to 5. The program depicted by these flowcharts is stored in the programmable ROM 14. First, when a pattern is selected through the pattern selection means 6 at step S1, layout screen display data is prepared at step S2. FIG. 5 shows a subroutine for preparing the layout screen display data.

That is, as shown at step S1 in FIG. 5, first the size of the cloth holding frame 2 and the size of the embroidered pattern selected through the pattern selection means 6 (the size is stored in embroidered pattern data) are entered through the information input means 7, the sizes of the cloth holding frame and the embroidered pattern displayed on the LCD screen 5 are found at step S2. Here, assuming that the dots making up the LCD screen 5 are arranged like a lattice with 0.6-mm pitches and that the size of the LCD screen is 96 mm×96 mm, the LCD screen 5 is made up of (96 mm÷0.6 mm)×(96 mm ÷0.6 mm)=25600 pixels. If the size of the selected cloth holding frame 2 is 64 mm×64 mm and is represented as 32 mm×32 mm on the LCD screen 5, the scale becomes ½. That is, the display pattern scale also becomes ½.

Then, control goes to step S3 and the absolute address of the stitch point position is found from the stitch point data of the embroidered pattern. Since the origin of the embroidered pattern is set to the lower-left corner, the lower-left corner is also considered as the origin for dot data on the LCD screen 5. Since the stitch point data is represented as the move distance from the current sewing position to the next sewing position, a relative position from one reference position cannot be recognized. Therefore, to display the stitch point data on the LCD screen 5, it is necessary to represent each stitch point position by a relative position from the pattern origin (lower-left corner). That is, the absolute address of the stitch point position needs to be found. It is found according to the following equations:

The coordinates of the n-th stitch, (Xn, Yn), are $$Xn = \frac{1}{2} \cdot Xmax + \sum_{k=1}^{n} xk$$

$$Yn = \frac{1}{2} \cdot Ymax + \sum_{k=1}^{n} yk$$

where Xmax and Ymax are the embroidered pattern size, (xk, yk) is the move distances of the k-th stitch in X and Y directions, and ((½) Xmax, (½) Ymax) is the center coordinates of the embroidered pattern (sewing is started at the position indicated by the coordinates).

When the absolute address of the stitch point position is thus found, control goes to step S4 at which the found absolute address is multiplied by the scaling factor found at step S2 to find the dot position corresponding to the stitch point position.

Then, control goes to step S5 at which whether or not the dot positions for all stitch points have been found is determined. If the dot position to be found remains, control returns to step S4. If the dot positions for all stitch points have been found, control goes to step S6 at which the data prepared in the dot image is converted into bitwise display data, and control goes to step S3 shown in FIG. 2.

Figure 2:
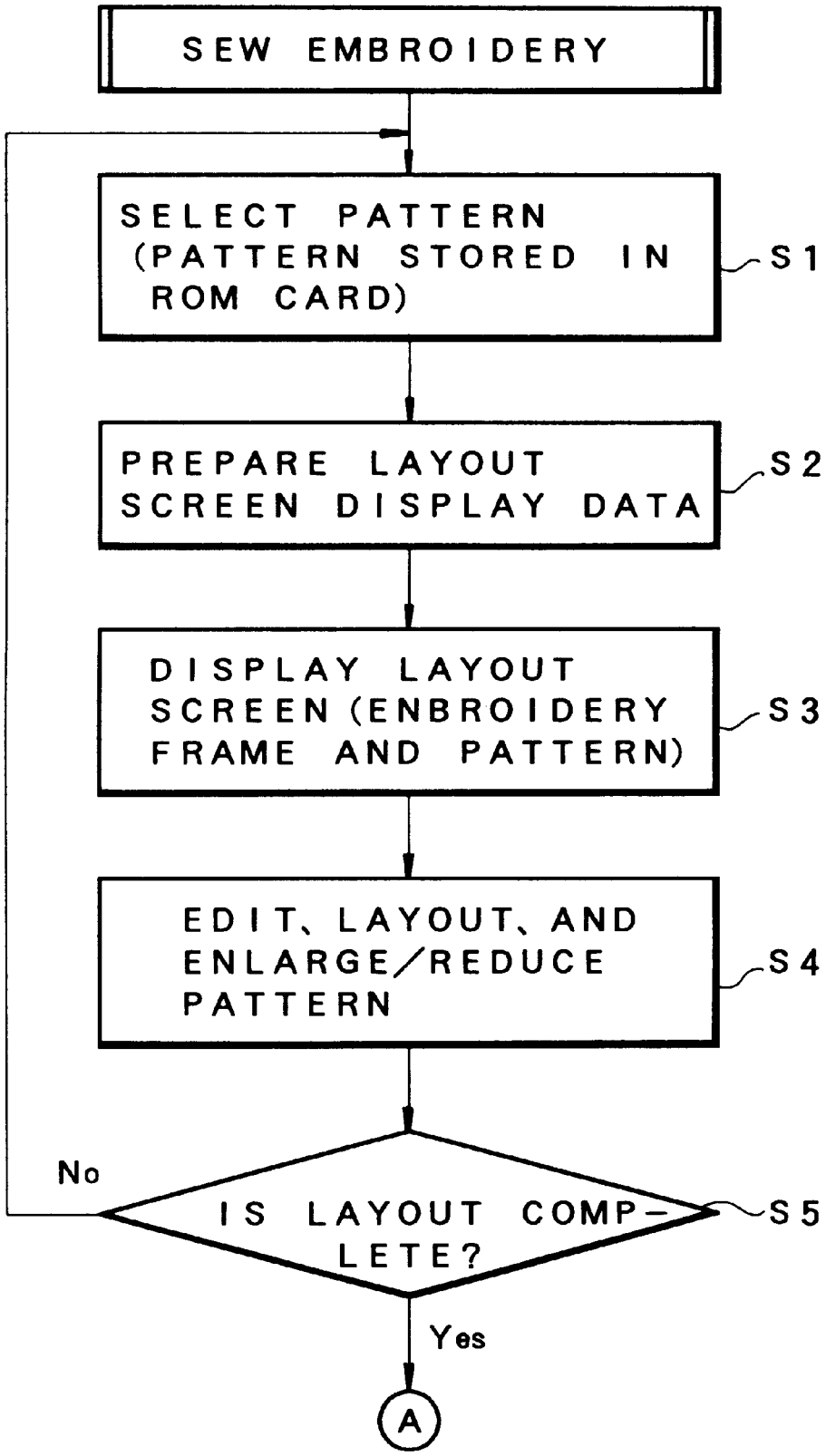
FIG. 2 is a flowchart to show an operation sequence of the pattern sewing machine in the embodiment of the invention.
Figure 3:
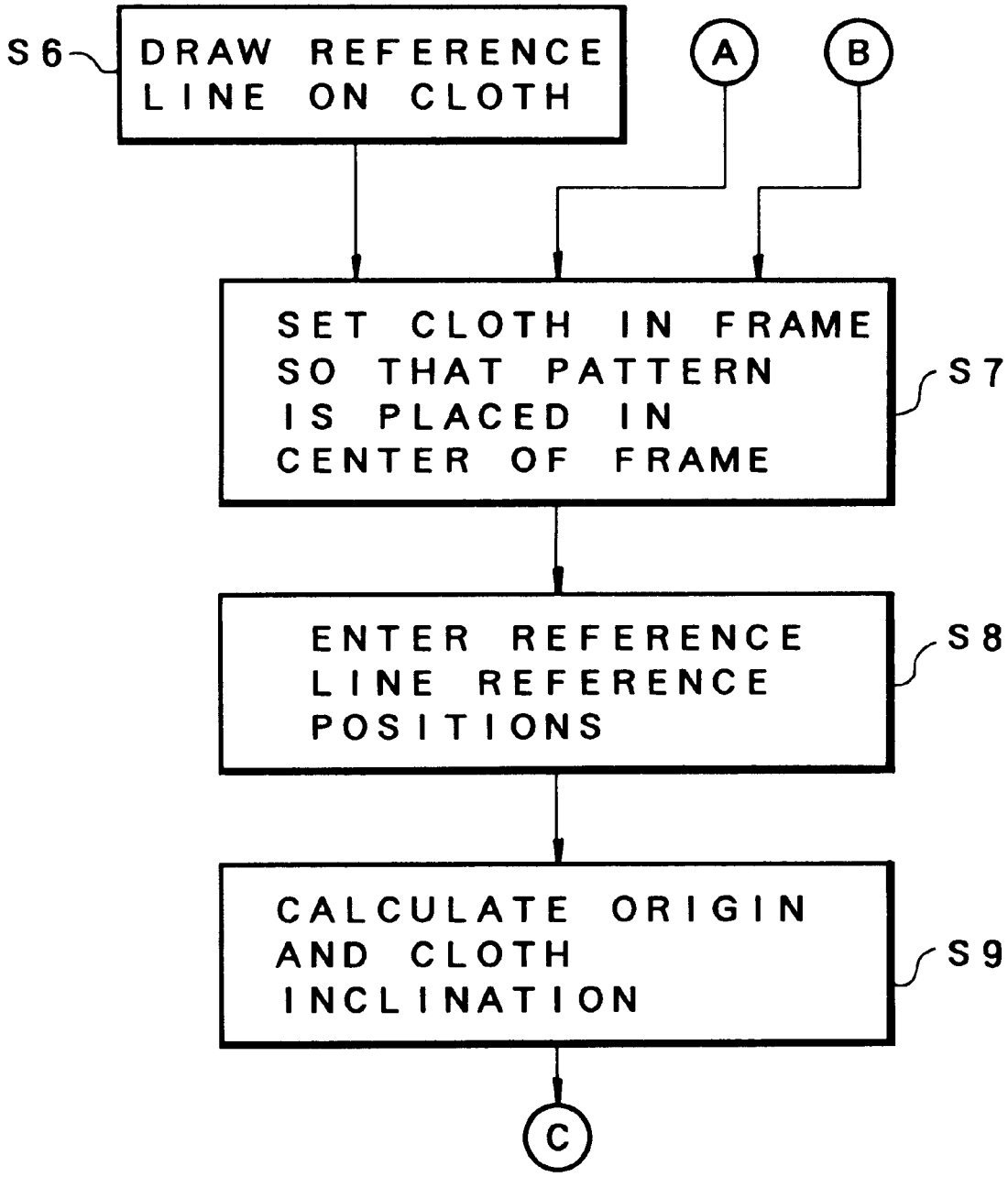
FIG. 3 is a flowchart to show an operation sequence following FIG. 2.
Figure 4:
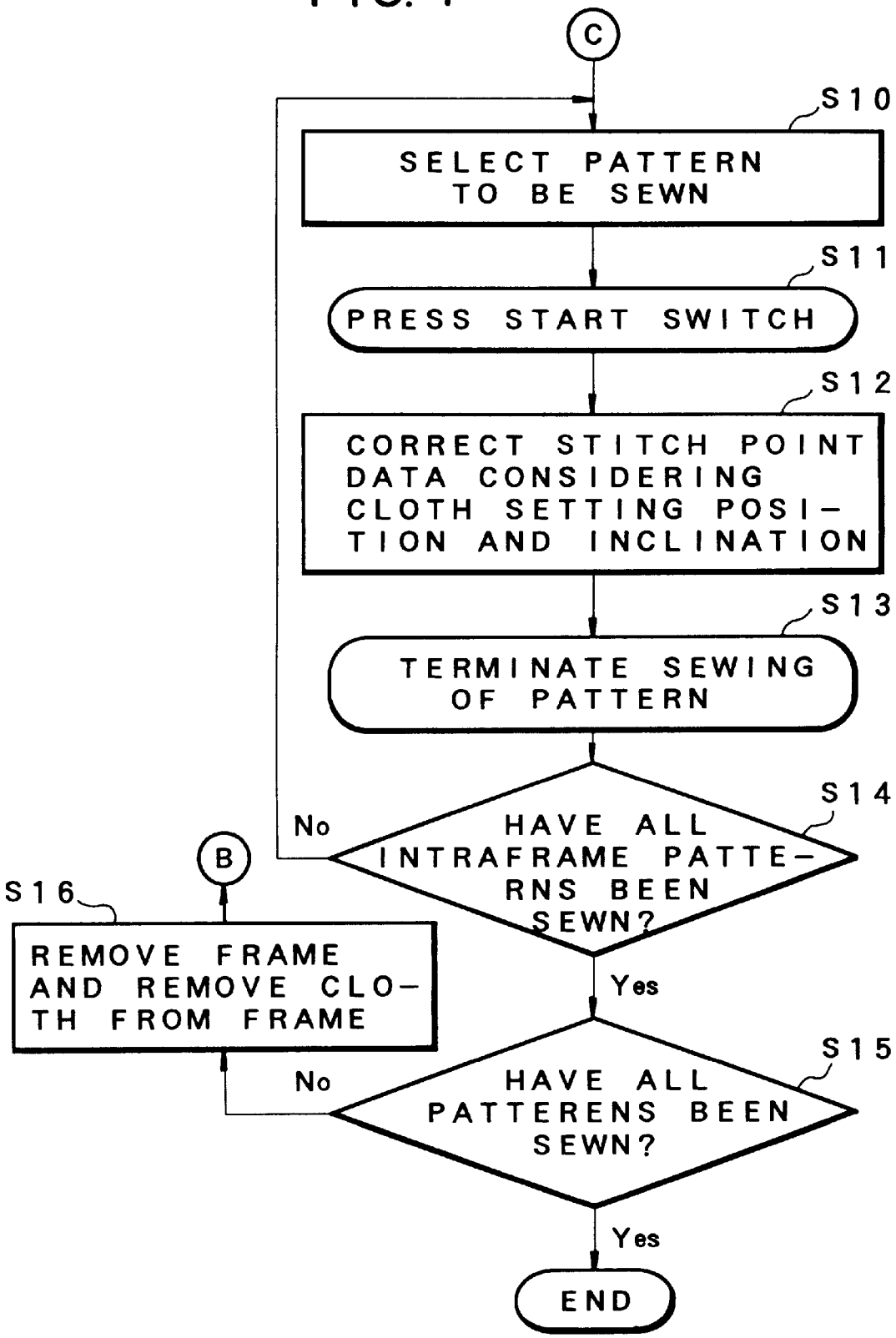
FIG. 4 is a flowchart to show an operation sequence following FIG. 3.

At step S3 in FIG. 2, the cloth holding frame and the embroidered pattern are displayed on the LCD screen 5 so that they can be laid out. In the embodiment, a screen as shown in FIG. 6 is displayed as a layout screen 30. The layout screen (96 mm×96 mm) 30 is partitioned into nine screens and a frame 31 corresponding to a cloth holding frame 2 is displayed in the size 32 mm×32 mm, as described above. Likewise, the display pattern found based on stitch point data and scaled is also displayed on the layout screen 30. In the prior art, the display pattern can be displayed only within the frame 31 displayed on the screen; in the embodiment, it can also be displayed outside the frame 31 displayed on the screen, facilitating layout. An X axis line 32, a Y axis line 33, and an auxiliary line 34 are also displayed on the layout screen 30, furthermore facilitating layout.

Then, control goes to step S4 at which the embroidered pattern is edited, laid out, enlarged, reduced, etc. That is, the displayed embroidered pattern can be scrolled to a desired position according to input of the layout setting means 9; as shown in FIG. 7 (*a*), the frame 31 displayed on the screen and the embroidered pattern in the frame 31 can be enlarged so as to match the layout screen 30; and as shown in FIG. 7 (*b*), the embroidered pattern enlarged fully on the layout screen 30 can be furthermore enlarged according to partitions as shown in FIG. 7 (*c*). The frame 31 and the embroidered pattern on the layout screen 30 can also be enlarged or reduced according to any scaling factor entered through the scaling factor input means 8. At the enlargement or reduction time, the display data is enlarged or reduced according to the setup (entered) scaling factor. The enlarged embroidered pattern shown in FIG. 7 (*b*) corresponds to partition (iv) shown in FIG. 7 (*c*).

Figure 9:
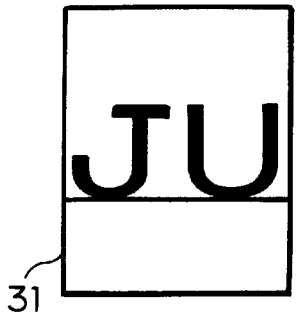
FIG. 9 is a front view to show the LCD screen on which a character string "JU" is displayed.

Now, assume that a character string of "JUKI" that extends off the cloth holding frame 2 is sewn as an embroidered pattern. That is, as shown in FIG. 9, only the character string part "JU" can be entered within the frame 31 on the layout screen 30 and can be sewn by one sewing.

Then, control goes to step S5 at which whether or not the layout is complete is determined. If the layout is not complete, control returns to step S1; if the layout is complete, control goes to step S7 shown in FIG. 3.

Figure 8:
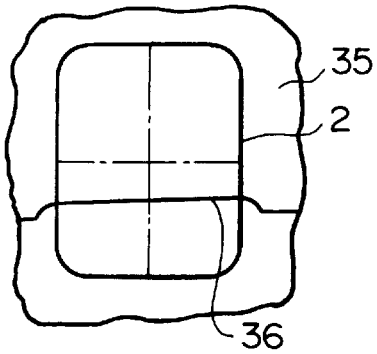
FIG. 8 is an illustration to show a state in which a cloth on which a reference line is drawn is set on a cloth holding frame.

Here, before control goes to step S7, a horizontal reference line 36 is drawn on a cloth 35, for example, with a French chalk pen at step S6, as shown in FIG. 8. The reference line 36 is a reference line for making the cloth parallel to the X axis of the cloth holding frame 2. This time, the embroidered pattern is sewn along the reference line 36.

When the reference line 36 is thus drawn on the cloth 35, the cloth 35 is set in the cloth holding frame 2 at step S7, as shown in FIG. 8. At this time, the cloth 35 is set so that the reference line 36 enters the cloth holding frame 2 and becomes almost parallel to the X direction of the cloth holding frame 2. Upon completion of setting the cloth 35, the cloth holding frame 2 holding the cloth 35 is mounted on the pattern sewing machine.

Figure 10:
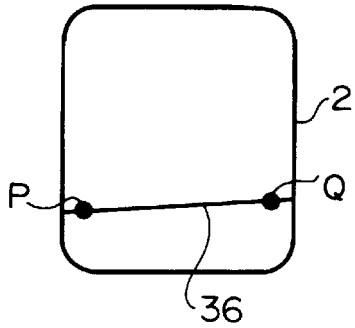
FIG. 10 is an illustration to show two arbitrary points P and Q set on the reference line of the cloth.

Then, control goes to step S8 at which a parameter according to which a rotation direction shift of the cloth 35 can be grasped is entered through the shift input means 10. To do this, first a switch of the shift input means 10 is set to a cloth correction mode, next a frame move key forming a part of the shift input means 10 is operated, thereby moving the cloth holding frame 2 so that the tip of the needle 101 comes on an arbitrary point (P) on the reference line 36, as shown in FIG. 10. Next, the needle rod is moved up and down at this position for checking to ensure that the point (P) is on the reference line 36. Next, a determination key forming a part of the shift input means 10 is turned on, thereby storing the coordinates of the point P from the origin. Next, the frame move key is operated, thereby moving the cloth holding frame 2 so that the tip of the needle 101 comes on an arbitrary point (Q) other than the point P on the reference line 36. Next, the needle rod is moved up and down at this position for checking to ensure that the point (Q) is on the reference line 36. Next, the determination key is turned on, thereby storing the coordinates of the point Q from the origin. Thus grasping the coordinates of the points P and Q on the reference line 36 results in parameter input that can grasp the rotation direction shift of the cloth 35 for the control means 13.

Then, control goes to step S9 at which the rotation direction shift of the set cloth 35 relative to the cloth holding frame 2, namely, cloth 35 inclination angle $_\theta$ is found. It can be found by the calculation means 13*g* which performs the following operation: For example, assuming that the coordinates of the point P are (3.8, 12.2) and that the coordinates of the point Q are (75.8, 13.5), the inclination angle $_\theta$ is $$\theta = \tan^{-1}\left(\frac{13.5 - 12.2}{75.8 - 3.8}\right) = 1.03^\circ$$

Then, control goes to step S10 at which if different embroidered patterns are laid out in the frame 31 on the layout screen 30, the embroidered pattern to be sewn is selected through the intraframe pattern selection means 12; if only one embroidered patterns is laid out as in the embodiment, the embroidered pattern detected by the detection means 13*h* (in the embodiment, "JU") is specified automatically.

Then, control goes to step S11 at which a sewing start switch (not shown) is turned on and control goes to step S12 at which the pattern control means 13*i* rotates the stitch point data of the character string "JU" at the inclination angle θ so that the character string "JU" to be sewn is placed along the reference line 36. At this time, the rotation correction of the stitch point data is made with the center of the cloth holding frame 2 as the rotation center.

If a part of the stitch point data is placed out of the cloth holding frame 2 by rotating the stitch point data, an alarm is produced to inform the worker of the event and the operation is stopped. Before sewing, rotation corrections of the stitch point data of all embroidered patterns can be previously made based on the inclination angle θ and the patterns which go in the cloth holding frame 2 are displayed at the pattern selection time for the worker to select a desired embroidered pattern which goes in the cloth holding frame 2.

Upon completion of sewing the character string "JU" based on the stitch point data subjected to the rotation correction, the system is stopped at step S13 and whether all intraframe patterns have been sewn is determined at step S14. If different embroidered patterns are laid out in the frame 31 on the layout screen 30, it is determined that another embroidered pattern needs to be sewn, and control returns to step S10. On the other hand, if all the intraframe pattern has been sewn as in the embodiment, control goes to step S15 at which whether all patterns have been sewn is determined.

If all patterns have been sewn, the control operation flow is terminated. In the embodiment, it is necessary to sew the character string "KI" following the character string "JU". Thus, control goes to step S16 at which the cloth holding frame 2 is removed from the pattern sewing machine and the cloth 35 is once removed from the cloth holding frame 2, then control returns to step S7.

Figure 11:
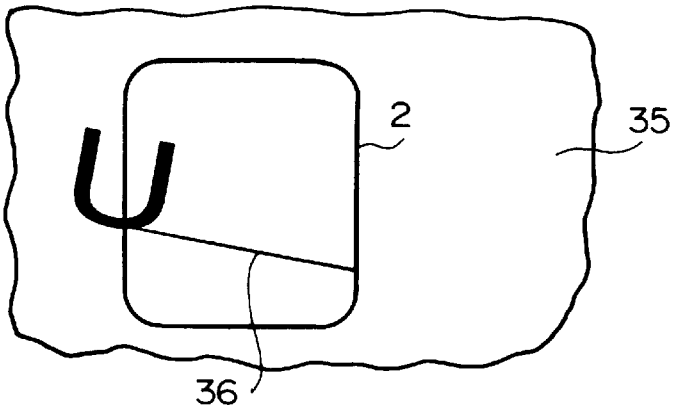
FIG. 11 is an illustration to show a state in which the cloth is again set on the cloth holding frame to sew a character string following the character string "JU;"

At step S7, as shown in FIG. 11, the cloth 35 is slid from the previous position and set in the cloth holding frame 2 so that the subsequent character string "KI" to be sewn can be sewn following the already sewn character string "JU." At this time, as shown in FIG. 11, the cloth 35 is set so that the reference line 36 enters the cloth holding frame 2 and becomes almost parallel to the X direction of the cloth holding frame 2 as at the preceding time; in addition, the cloth 35 is set so that at least a part of the last sewn "U" character enters the cloth holding frame 2. Upon completion of setting the cloth 35, the cloth holding frame 2 holding the cloth 35 is mounted on the pattern sewing machine.

Then, control goes to step S8 at which the coordinates of two arbitrary points on the reference line 36 on the current set cloth 35 are stored by a similar method to the previous method. Control goes to step S9 at which inclination angle θ of the current set cloth 35 relative to the cloth holding frame 2 is found by a similar method to the previous method.

Figure 12:
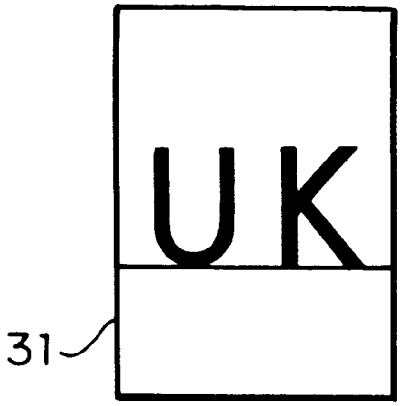
FIG. 12 is a front view to show the LCD screen on which a character string "UK" is displayed.
Figure 13:
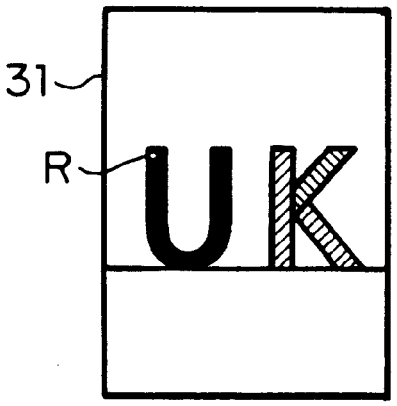
FIG. 13 is a front view to show the first displayed LCD screen when a reference point is specified for character "U" on the LCD screen.

Then, control goes to step S10 at which first display data is scrolled so that the character "U" enters the frame 31 on the layout screen 30, as shown in FIG. 12. Next, a stitch point display switch forming a part of the recognition means 11 is turned on for setting a stitch point display mode. Next, the character "U" for which stitch point display is produced is specified in the mode. Then, the stitch point position of the target character is displayed as a hollow part. Just after the specification, the stitch point position of the first stitch of the target character "U" is displayed as a hollow part indicated by R as shown in FIG. 13. At this time, the character "K" other than the specified character is displayed at halftone. Then, a forward switch, a back switch, etc., of the stitch point display switch forming a part of the recognition means 11 is operated for moving the handling of the needle to the reference point of the character "U" in the frame 31 on the layout screen 30.

Figure 14:
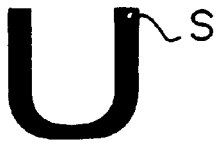
FIG. 14 is a front view to show a state in which the reference point is specified for the character "U" on the LCD screen.

In the embodiment, the last stitch point position of the last sewn character "U" is used as the reference point. Thus, when the handling of the needle is moved to the reference point S (see FIG. 14), a position specification key forming a part of the recognition means 11 is turned on for storing the position of the reference point S.

Then, the frame move key is operated for moving the cloth 35 held on the cloth holding frame 2 so that the tip of the needle 101 is positioned on the reference point S of the already formed character "U," namely, is positioned on the last stitch point position of "U." The needle rod is moved up and down for checking to ensure that the tip of the needle 101 matches the reference point. Next, a cloth position determination key forming a part of the recognition means 11 is turned on, thereby storing the set position of the cloth 35 relative to the cloth holding frame 2.

In the embodiment, the reference point is used as the last stitch point position of "U." Thus, if the stitch point data of the character string "KI" is read, "KI" can be sewn without any shift in the X or Y direction from "U" (a rotation direction shift exists). The reference point is set to any other stitch point position than the last stitch point position of "U," the reference point is specified on the layout screen 30, the cloth holding frame 2 is moved so that the tip of the needle 101 is positioned on the reference point, and the cloth position determination key is turned on, as described above. In doing so, the pattern control means **13*i* reads the stitch point position corresponding to the reference point on the layout screen 30 from the data stored in the RAM edit buffer 15**, and the first stitch point position of the next character to be sewn "K" (also at this time, stitch point position with no shift in the X or Y direction, but with a rotation direction shift) can be found from the stored data.

Figure 15:
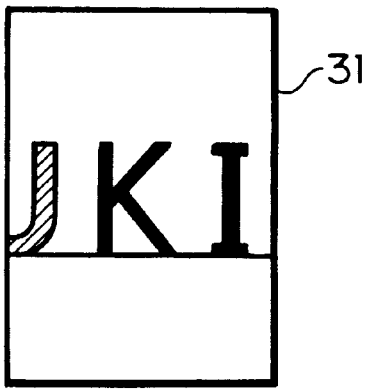
FIG. 15 is a front view to show the LCD screen on which a part containing the reference point of the already formed character "U" and a character string "KI" are displayed.

The character string is furthermore scrolled on the layout screen 30 so that the character string "KI" goes in the frame 31 on the screen, as shown in FIG. 15. At this time, a part of the character "U" which goes in the frame 31 on the screen, but is not yet sewn is displayed at halftone. In the embodiment, only one embroidered pattern is laid out. Thus, the embroidered pattern detected by the detection means **13*h*** (in the embodiment, "KI") is specified automatically.

Figure 16:
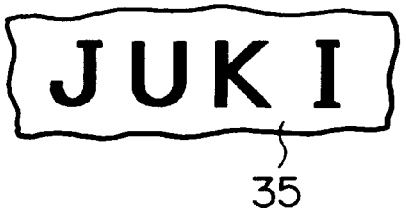
FIG. 16 is an illustration to show the final character string "JUKI" formed on the cloth.

Then, as at the preceding time, the sewing start switch is turned on at step S11 and the pattern control means **13*i* rotates the stitch point data of the character string "KI" at the inclination angle θ occurring by again setting the cloth so that the character string "KI" to be sewn is placed along the reference line 36. At this time, the rotation correction of the stitch point data of "KI" is made with the reference point as the rotation center. The subsequent operation is the same as the operation at the preceding time. Finally, the character string pattern "JUKI" with no shift in the X, Y, or rotation direction is formed on the cloth 35 with a predetermined character spacing, as shown in FIG. 16**.

Thus, in the embodiment, an enlarged or reduced embroidered pattern displayed on the LCD screen 5 is formed from the stitch point data of the embroidered pattern. The display pattern data concerning enlargement or reduction (image display data) need not previously be stored in the ROM. Therefore, a small-capacity ROM can be used and costs can be reduced.

When a large-sized embroidered pattern or an embroidered pattern of a character string, etc., is sewn, if sewing of the embroidered pattern is not completed by one sewing (the embroidered pattern does not go in the cloth holding frame 2), the relative positions of the already formed embroidered pattern and the subsequent embroidered pattern to be sewn are not shifted in the X, Y, or rotation direction. Thus, the complete embroidered pattern can be sewn in fine matching and the sewing quality can be improved.

Having described our invention as related to the embodiment shown in the accompanying drawings, it is our intention that the invention be not limited by any of the details of description, unless otherwise specified, but rather be constructed broadly within its spirit and scope as set out in the accompanying claims.

For example, in the embodiment, if an enlargement factor is large to particularly enlarge a part of an embroidered pattern for display, its outline (silhouette) may be unclear simply by producing dot display from the stitch point data. In such a case, if the dot display is turned on so as to connect the stitch point points in order, for example, linearly, a fine outline can be provided.

The dot display may be black points on white background, hollow black points, or halftone display and is not limited. If color display can be produced, the dot display color may be changed for each thread color.

Enlarged or reduced stitch point display data needs to be rounded (approximated) so as to match the pixels of the LCD screen 5 depending on the scaling factor; such operation is extremely easy.

In the embodiment, the drive form of the cloth holding frame 2 is the X, Y drive form, but the pattern sewing machine of the invention can also be applied to R-θ drive form.

In the embodiment, the inclination angle θ of the cloth 35 to the cloth holding frame 2 is found as the opening angle between the X axis and the horizontally drawn reference line 36, but may be found as the opening angle between the Y axis and a vertically drawn reference line or both may be used.

In the embodiment, the French chalk line 36 is drawn on the cloth 35 as the reference line and two arbitrary points P and Q on the reference line 36 are used to find the inclination angle θ, but any may be used if it can become a reference on the cloth 35; for example, two or more reference marks may be previously sewn for use as the reference, a pattern on the cloth 35 may be used, or a line used as a reference line may be temporarily sewn with thread for use as the reference.

In the embodiment, the reference point S is the position of the last stitch of the last sewn embroidered pattern or may be any stitch point position of the last sewn embroidered pattern, but a reference point may be previously formed on the cloth 35 (at a position other than an embroidered pattern) for use as the reference.

In the embodiment, the worker sets the reference point S, but the reference point may be fixed rather than selected. In this case, the reference point may be the position of the last stitch of the formed embroidered pattern as described above or may be the rightmost position of the formed embroidered pattern.

In the embodiment, the two points P and Q are arbitrary points, but may be fixed depending on the pattern. That is, for example, the point moved a predetermined distance (fixed distance) in the X or Y direction after point P is selected may be adopted as point Q.

In the embodiment, the two points P and Q are specified, whereby the inclination angle θ is found by performing an operation. However, for example, an inclination angle is entered and the cloth holding frame 2 is moved according to the angle and if the tip of the needle 101 runs in parallel with the French chalk line 36, the angle can also be determined the inclination angle. In this case, whenever the tip of the needle 101 does not run in parallel with the French chalk line 36, the inclination angle is changed and a similar determination is made.

In the embodiment, the cloth holding frame 2 is a known embroidery frame, but may be any if it can hold the cloth 35.

In the embodiment, the two points P and Q are specified and the data is read, then the reference point is set. However, after the reference point is set, the two points P and Q may be specified and the data may be read.

In addition to the reference point, the two points P and Q may be set on point display of the LCD screen 5.

All the operation described above may be displayed on the LCD screen 5 by executing the following steps of (1) displaying the reference line set on the cloth to form an embroidered pattern, (2) displaying the embroidered pattern to be sewn on the cloth held in the cloth holding frame along the displayed reference line based on embroidered pattern data (stitch point data), (3) displaying the two points P and Q on the reference line of the cloth held in the cloth holding frame, and (4) correcting sewn embroidered pattern data by rotating the sewn embroidered pattern data with the reference point as the center based on the two points P and Q and displaying the corrected data.

As we have discussed, the pattern sewing machine of the invention recognizes the reference point of the cloth in the cloth holding frame by the recognition means, can space the stitch point data of the current sewing pattern to be sewn in the cloth holding frame at a predetermined pattern distance apart from the already formed embroidered pattern in the X and Y directions by the correction means based on the reference point, detects a rotation direction shift of the cloth set in the cloth holding frame by the rotation direction shift detection means, and corrects the stitch-point data spaced at the predetermined pattern distance apart from the already formed embroidered pattern in the X and Y directions in the rotation direction with the reference point as the center by the correction means based on the reference point and the cloth rotation direction shift, thereby finely matching the relative positions of the already formed sewing pattern and the subsequent sewing pattern to be sewn. Thus, the sewing quality can be improved.

According to the pattern sewing method of the invention, like the pattern sewing machine, to form an embroidery of a size that cannot go in the embroidery frame at a time, the relative positions of the already formed sewing pattern and the subsequent sewing pattern to be sewn can be matched finely. Thus, the sewing quality can be improved.

According to the pattern display method of the invention, the steps are displayed, so that operability can also be improved.

What is claimed is:

1. A pattern sewing machine comprising:

a cloth holding frame having a predetermined area, for holding a cloth;

a driving member for moving said cloth holding frame in X and Y directions;

display means having a display screen, for displaying a pattern to be sewn, wherein the pattern displayed on said display screen is stitched on the cloth held by said cloth holding frame which is moved in the X and Y directions;

rotation direction shift detection means for detecting a rotation direction shift of the cloth set in said cloth holding frame;

recognition means for recognizing a reference point of the cloth in said cloth holding frame; and correction means for instructing a correction to said drive member based on the reference point recognized by said recognition means and the cloth rotation direction shift detected by said rotation direction shift detection means.

2. The pattern sewing machine according to claim 1, further comprising:

means for setting a reference line on the cloth to form embroidery sewing;

means for forming a part of an embroidery based on embroidery data on the cloth held in said cloth holding frame such that the reference line is placed along one side of said cloth holding frame;

means for changing the holding position of the cloth in the cloth holding frame so as to enable a different part of the embroidery to be successively formed in a different place of the cloth;

means for setting two points on a new reference line of the cloth newly held in said cloth holding frame;

means for correcting sewn embroidery data by transforming the sewn embroidery data so that the data corresponds to a rotated pattern with a reference point determined based on positions of the two points; and means for forming the different part of the embroidery based on the corrected embroidery data.

3. The pattern sewing machine as claimed in claim 2, wherein the predetermined reference point is read before or after the two points are read, whereby the reference point is set.

4. The pattern sewing machine as claimed in claim 2 or 3, wherein the two points or the predetermined reference point is set on said display screen.

5. A pattern sewing machine for forming an embroidery on a workpiece, said embroidery being of a size that cannot be sewn in an embroidery frame without repositioning the workpiece with respect to the frame, said pattern sewing machine comprising:

means for displaying a previous reference line set on a cloth previously held in the embroidery frame to form embroidery sewing;

means for displaying an embroidery to be sewn on the cloth newly held in the embroidery frame along the previous reference line based on embroidery data;

means for displaying two points on a new reference line of the cloth newly held in the embroidery frame; and means for correcting sewn embroidery data by transforming the sewn embroidery data so that the data corresponds to a rotated pattern with a predetermined reference point as the center of a line extending between the two points.

6. The pattern sewing machine as claimed in claim 5, wherein the predetermined reference point is displayed before or after the two points are displayed.

7. A pattern sewing machine comprising:

a cloth holding frame having a predetermined area, for holding a cloth;

a driving member for moving said cloth holding frame in X and Y directions;

display means having a display screen for displaying a pattern to be sewn, wherein the pattern displayed on said display screen is stitched on the cloth held by said cloth holding frame which is moved in the X and Y directions;

means for assigning an absolute position of the cloth held by said cloth holding frame;

means for rearranging the pattern displayed on said display screen such that the pattern corresponds to the absolute position, wherein the absolute position is a particular reference position on the part of the pattern which has been sewn;

means for controlling said driving member to form the pattern corresponding to the pattern rearranged on the display screen.

8. The pattern sewing machine according to claim 7, wherein the absolute position is a rotational direction position.

* * * * *